United States Patent [19]

Mougin

[11] 4,201,498

[45] May 6, 1980

[54] METHOD FOR RAPIDLY MELTING AN ICEBERG

[75] Inventor: Georges L. Mougin, Paris, France

[73] Assignee: ITI Limited, Paris, France

[21] Appl. No.: 884,407

[22] Filed: Mar. 8, 1978

[30] Foreign Application Priority Data

Mar. 8, 1977 [FR] France ..... 77 06702

[51] Int. Cl.[2] ..... F25D 1/00

[52] U.S. Cl. ..... 405/303; 62/260; 137/236 S; 62/74

[58] Field of Search ..... 405/61, 303; 62/74, 62/260, 347; 239/182; 299/3; 134/5; 137/236 S

[56] References Cited

U.S. PATENT DOCUMENTS

| | | | |
|---|---|---|---|
| 856,348 | 6/1907 | Josewski | 299/3 |
| 2,681,828 | 6/1954 | Pollard | 134/5 |
| 3,289,415 | 12/1966 | Merrill | 405/76 |
| 3,431,394 | 3/1969 | Hopper | 126/360 R X |
| 3,791,163 | 2/1974 | Dickson et al. | 62/347 |
| 4,030,305 | 6/1977 | Wilson | 405/61 |

OTHER PUBLICATIONS

Time Magazine, Oct. 17, 1977, p. 65, "Towing Icebergs".

*Primary Examiner*—Lloyd L. King
*Assistant Examiner*—William E. Tapolcai, Jr.
*Attorney, Agent, or Firm*—George E. Kersey

[57] ABSTRACT

To melt an iceberg once it has been brought to a tropical region where it is to act as a source of fresh water, use is made of the warm breezes of such tropical regions. Droplets of an artificial rain of cold fresh water are caused to drop through the warm air, thereby extracting heat from it. This heat is used to melt the iceberg. Preferably the cold fresh water comes from a pool of cold fresh water on the surface of the iceberg, and the artificial rain falls back into the pool. At night this method can also condense extra water from the air.

9 Claims, 1 Drawing Figure

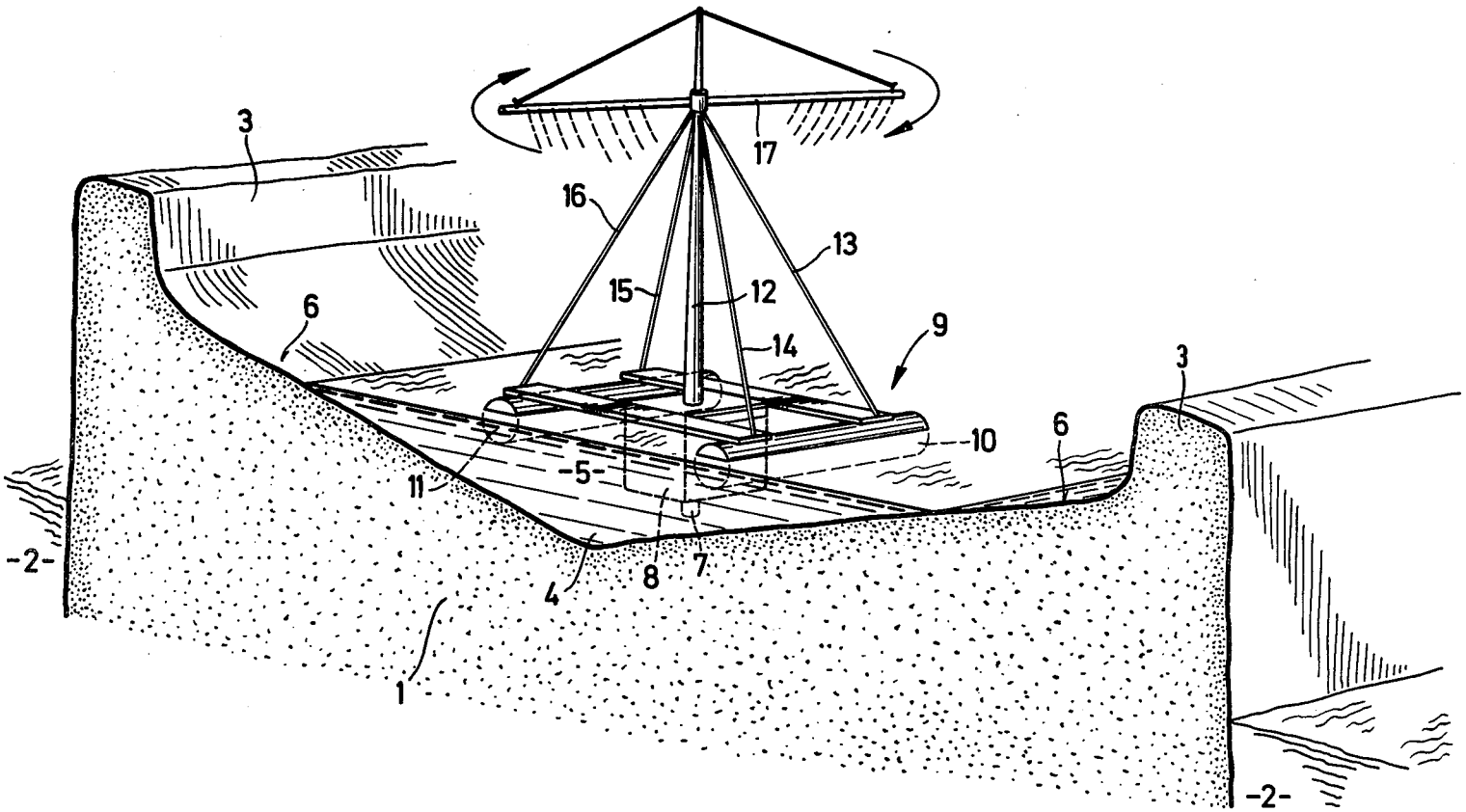
-2-
3
6
10
9
13
14
12
17
7
8
15
16
-5-
4
11
1
6
3
-2-

METHOD FOR RAPIDLY MELTING AN ICEBERG

The present invention concerns the rapid melting of tabular icebergs to supply fresh water to dry regions close to the coast.

The use of tabular icebergs from the Antarctic in the Northern hemisphere means that they must cross the equatorial region situation between the two Tropics (latitude 46°), a distance of 2,760 nautical miles. This distance can be covered in 2,700 hours at a speed of 0.5 m/s, which has been found to be economical for the transportation of icebergs with dimensions of about 3,000×750×250 meters.

The use of tabular icebergs from the Antarctic as sources of freshwater for dry regions means that if they are to be melted in less than two or three years use must be made of devices assisting the action of solar radiation. In tropical regions the solar energy level is 8 to 10 $GJ/m^2$ per year, which would only melt 25 meters of ice (i.e. a volume of 25 $m^3$), even if 100% efficiency could be achieved. This thickness of ice is small in comparison with the average thickness of tabular icebergs, which is around 250 meters, the vertical dimension of the submerged portion being 6 to 8 times the height above the waterline.

Rapid melting is also required in order to reduce the length of time for which the watering and sidewall insulation equipment is tied up. Also, loss of fresh water from the submerged surfaces of the iceberg would become unacceptable in warm waters.

The present invention is intended to provide a method for using the heat energy of atmospheric air to accelerate the melting of an iceberg off the coast of a dry region in or near the tropics. In such regions there are air currents moving at around 20 km/h and laden with moisture. These ensure practically continuous renewal of the atmospheric air, which is at a temperature of 20° to 30° C. The volume of air blown through an area 30 meters high and 1,000 meters wide by a 20 km/h wind is around 150,000 $m^3/s$. If this can be cooled through 10° C. the heat input is about 550 thermie/s. This is capable of melting six tonnes of ice per second, or 180 million $m^3$ of ice per year. For a tabular iceberg 3,000×750×250 meters, this represents a thickness of 70 meters, the surface area being about 2.25 million $m^2$. This is several times the thickness that can be melted relying solely on solar radiation.

The advantage of atmospheric air as a source of heat is that no special equipment such as burners is required, as its temperature is already 20° C. higher than that of the ice. Nor does it require special heat exchanger surfaces.

The method in accordance with the present invention is not comparable with that used in cooling towers because in this instance the intention is to take warmth from the air to warm water which is 20° C. cooler than the air, using as the heat exchange surface the surfaces of droplets of artificially induced rain falling onto the iceberg across which the wind blows.

The substantially horizontal upper surface of a tabular iceberg has a pool hollowed out in it for storing the fresh water produced by melting the iceberg, using a method disclosed elsewhere by the present applicants.

In one embodiment of the invention the cold fresh water in the storage pool is transformed into droplets of artificially induced rain by pumping it up hollow masts and spraying it out at various angles, so as to cover the maximum volume of atmospheric air. It is also possible to use nozzles which spray the water vertically upwards in such a way as to maximise the time spent in the atmosphere by the water droplets. In another embodiment of the invention, the cold water is run along a horizontal wheel from which hang vertical filaments. The water droplets run down these more slowly than they would fall freely under gravity, so that the time of exposure to the atmospheric air is increased. Thus the cold fresh water sprayed as artificial rain is taken from the storage pool hollowed out of the substantially horizontal upper surface of the iceberg to fall back into the pool after being warmed, giving up its heat to the fresh water stored in the pool. The bottom of the storage pool is at a temperature close to 0° C., so that there will be strong convection currents near the bottom of the pool, fresh water having a maximum density at 4° C. Because of this, the exchange of heat between the ice and the water heated by the artificially induced rain is excellent, and accelerates the melting of the iceberg.

As the use of the method in accordance with the invention requires that the cold water for the artificially induced rain should be taken from the storage pool hollowed out of the substantially horizontal upper surface of the iceberg and fall back into it after being heated, it is convenient to float a number of devices for artificially inducing rain on the surface of the cold fresh water in the pool. This means that it is always possible to have artificially induced rain falling on the iceberg, whatever its orientation with respect to the wind.

Furthermore, the method in accordance with the present invention can be used day and night. During the night the relative humidity of the air increases because of the drop in temperature, and often exceeds 90%. As a result of the artificially induced rainfall, which cools the air to warm the water droplets, the atmospheric water vapour is condensed. This means that it is possible to produce more soft water than can be produced merely by melting the iceberg.

The invention will now be described in more detail, by way of example only.

The accompanying drawing shows a partial cross-section in perspective of a tabular iceberg (1) floating on the sea (2). The iceberg (1) has hollowed out of its substantially horizontal upper surface a storage pool defined by edges (3). The bottom of the pool is V-shaped in order to facilitate the connection of soft water resulting from the melting of the iceberg (1). The cold fresh water (5) collects in the pool, but does not entirely cover its inclined bottom (6). The water resulting from the melting of the iceberg (1) is the cold freshwater which, in accordance with the invention, is heated in order to accelerate the melting of the iceberg (1). The water take off point (7) is immersed in the deepest part of the storage pool, corresponding to the apex (4) of the V-shape. The cold freshwater (5) is at a temperature close to 0° C., and is drawn up by the pump (8) placed beneath the platform of the raft (2) including two cylindrical floats (10) and (11) which are of such dimensions that the raft (9) is incapable of capsizing, due account being taken of the respective weights of the mast (12) and the pump (8). The mast (12) is retained by stays (13) to (16) which, with the floats (10) and (11), form a rigid tetrahedron with a rectangular base. A horizontal yarn arm (17) is located perpendicular to the mast (12) and can rotate about the mast. This yard arm is used to spray the cold water. It is retained by stays. Such a raft (9) can evidently move on the surface of the water storage pool, so as to be located on the windward side of the iceberg (1). A number of rafts (9) are used, in order to make use of the greatest possible volume of warm air.

The height of the mast (12) and the length of the yard arm (17) determine the flow of warm air which exchanges heat with the cold freshwater (5) pumped up by the pump (8) passed up the mast (12) and sprayed out by the yard arm (17).

During the day, the droplets of artificially induced rain are heated by the wind and fall back into the storage pool which is filled with cold fresh water (5) and also on the portions of the inclined bottom (6) of the storage pool which are not covered with water. The cold water (5) in the pool is heated in its turn by thermal exchange with the droplets of artificially induced rain which are at a temperature higher than that of the cold water (5) in the pool. This water is in contact with the mass of the iceberg (1) as the storage pool is directly hollowed out from the ice of the iceberg. It tends to rise to the surface as it is less dense than the cold water heated by thermal exchange with the droplets of artificially induced rain. As a result, thermal exchange between the ice of the iceberg (1) and the cold water (5) heated by thermal exchange with the droplets of artificially induced rain, themselves heated by thermal exchange with the warm air blowing over the iceberg (1), corresponds to a very active convection which equalises the temperature of the soft water contained in the storage pool hollowed out of the substantially horizontal upper surface of the iceberg (1).

During the night the droplets of artificially induced rain are heated by the wind which blows over the iceberg (1) and fall into the storage pool filled with water (5) and also onto the portions of the inclined bottom (6) of the storage pool which are not covered with water. The relative humidity of the air is often greater than 90%, and the air is cooled, giving up heat to the water droplets of the artificially induced rain. Because of this, the relative humidity of the air increases and condensation of the water vapour in the air is increased. Thus the artificially induced cold rain is warmed and produces a warm natural rainfall by condensation. This natural rain also falls into the storage pool and produces strong convection currents. A notable feature of the invention is that the total volume of soft water produced is greater than that produced merely by melting the ice of the iceberg.

The claims defining the invention are as follows:

1. Method of melting an iceberg comprising the steps of:

(1) using melted water from the iceberg to artificially induce a rain of cold fresh water; and (2) allowing said rain of cold fresh water to fall upon said iceberg from the melting thereof.

2. Method according to claim 1 wherein the droplets of said rain are heated and the heat is transferred to said iceberg when said droplets fall thereon.

3. Method according to claim 1 wherein said rain of cold fresh water is used to condense atmospheric water vapor and increase the supply of cold fresh water on the iceberg.

4. Method according to claim 2 wherein the droplets are heated by falling through atmospheric air which has a temperature higher than that of the iceberg.

5. A method according to claim 1, wherein the cold fresh water used for producing the artificially induced rain is taken from a pool hollowed out of the substantially horizontal upper surface of the iceberg and, when heated, falls back into said pool.

6. A method according to claim 5, the artificial rain is induced by a device which is located on a raft floating on said pool, and which is movable to the windward side of the iceberg.

7. A method according to claim 6, wherein a plurality of rafts are located on the windward side of the iceberg in operation.

8. A method according to claim 5, wherein the droplets of the artificially induced rain give up their heat to warm the surface layer of the pool as they fall therein.

9. A method according to claim 5, wherein the water in the pool is at an evenly distributed temperature because of strong convection currents in the pool.

* * * * *